US008233837B2

(12) United States Patent
Sato

(10) Patent No.: US 8,233,837 B2
(45) Date of Patent: Jul. 31, 2012

(54) IMAGE FORMING APPARATUS

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 855 days.

(21) Appl. No.: 12/234,059

(22) Filed: Sep. 19, 2008

(65) Prior Publication Data

US 2009/0087237 A1 Apr. 2, 2009

(30) Foreign Application Priority Data

Oct. 2, 2007 (JP) ..... 2007-258592

(51) Int. Cl.
*G03G 15/00* (2006.01)

(52) U.S. Cl. ..... 399/401; 399/388; 399/396; 399/397; 399/395; 271/186; 271/291

(58) Field of Classification Search ..... 399/388, 399/397, 401, 395, 396; 271/186, 291
See application file for complete search history.

(56) References Cited

U.S. PATENT DOCUMENTS

| | | | | |
|---|---|---|---|---|
| 5,083,170 | A | 1/1992 | Sawada et al. | |
| 5,781,823 | A * | 7/1998 | Isobe et al. | 399/2 |
| 7,258,500 | B2 * | 8/2007 | Furihata et al. | 400/188 |
| 7,374,281 | B2 * | 5/2008 | Saito et al. | 347/104 |

FOREIGN PATENT DOCUMENTS

| | | |
|---|---|---|
| JP | 01-122835 | 5/1989 |
| JP | 02-292075 | 12/1990 |
| JP | 05-138965 | 6/1993 |
| JP | 07-244407 | 9/1995 |
| JP | 2005-141019 | 6/2005 |

OTHER PUBLICATIONS

Notification of Reasons for Refusal for Japanese Application No. 2009-257740 mailed on Feb. 9, 2010.

Notifications of Reasons for Refusal for Japanese Application No. 2007-258592 mailed on Oct. 6, 2009.

* cited by examiner

*Primary Examiner* — Matthew G Marini
(74) *Attorney, Agent, or Firm* — Banner & Witcoff, Ltd.

(57) ABSTRACT

An image forming apparatus is provided and includes an image forming unit that forms an image on a recording sheet at an image forming position; a regulating roller that conveys the recording sheet; a supply path from the regulating roller to the image forming position; an inversion path that is configured to merge with a position on the supply path between the regulating roller and the image forming position and bends and inverts the sheet; a return path that is configured on an opposite side of the regulating roller from the supply path to return the recording sheet to the supply path; and a control unit which rotates the regulating roller in a return rotational direction to convey the inverted recording sheet into the return path, and in a feed rotational direction to convey the recording sheet to the image forming position.

13 Claims, 12 Drawing Sheets

IMAGE FORMING APPARATUS

CROSS REFERENCE TO RELATED APPLICATION

The present application claims priority from Japanese Patent Application No. 2007-258592, which was filed on Oct. 2, 2007, the disclosure of which is herein incorporated by reference in its entirety.

TECHNICAL FIELD

Apparatuses consistent with the present invention relate to an image forming apparatus, and more particularly, to a sheet inverting mechanism for double-sided printing.

BACKGROUND

A related art image forming apparatus is described in Japanese unexamined patent application publication No. JP-A-1-122835 (Patent Document 1). In the related art image forming apparatus, a recording sheet is conveyed to an image forming unit where an image is formed on the surface of the recording sheet, and then the recording sheet is inverted and again conveyed to the image forming unit to form an image on the rear surface of the recording sheet.

Further, the related art image forming apparatus has a supply path that guides the recording sheet to the image forming unit and an inversion path for conveying the recording sheet conveyed from the image forming unit while bending the recording sheet, to invert the direction of the recording sheet, and again guiding the recording sheet to the supply path.

The inversion path is configured to merge with the supply path at a position upstream of a regulating roller (an upstream position with reference to a direction in which the recording sheet is conveyed by the regulating roller).

The recording sheet re-conveyed from the inversion path to the supply path is again conveyed to the regulating roller by a switchback roller that is disposed upstream of a junction between the supply path and the inversion path and that can rotate in both a forward and reverse direction.

SUMMARY

However, the related art image forming apparatus has some disadvantages. For example, in the related-art image forming apparatus, the inversion path merges with the supply path upstream of the regulating roller, and therefore a portion of the image forming apparatus located upstream of the regulating roller is occupied by the inversion path, which makes it difficult to effectively utilize the space and reduce the size of the overall apparatus.

Exemplary embodiments of the present invention address the above disadvantages and other disadvantages not described above. Aspects of the present invention relate to the above problem. However, the present invention is not required to overcome the disadvantages described above, and thus, an exemplary embodiment of the present invention may not overcome any of the problems described above.

It is an aspect of the present invention to provide an image forming apparatus that can form an image on either side of a recording sheet and effectively use an internal space of the image forming apparatus.

According to an illustrative aspect of the present invention, there is provided an image forming apparatus comprising an image forming unit that forms an image on a recording sheet at an image forming position; a regulating roller that regulates movement of a leading end of the recording sheet and conveys the recording sheet to the image forming position; a supply path for supplying the recording sheet conveyed from the regulating roller to the image forming position; an inversion path that is configured to merge with a position on the supply path between the regulating roller and the image forming position, the inversion path inverting a course of the recording sheet by guiding the recording sheet conveyed from the image forming unit while bending the sheet and causing the recording sheet to merge with the supply path, thereby again guiding the inverted recording sheet to the supply path, a return path for returning the recording sheet guided from the inversion path to the supply path to a side opposite to the supply path with respect to the regulating roller; and a control unit for controlling rotation of the regulating roller in a feed rotational direction and a return rotational direction opposite to the feed rotational direction; wherein the control unit rotates the regulating roller in the return rotational direction, thereby conveying the recording sheet guided from the inversion path to the supply path to the return path, and rotates the regulating roller in the feed rotational direction, thereby again conveying the recording sheet to the image forming position.

According to another exemplary embodiment of the present invention, there is provided an image forming apparatus capable of forming an image on either side of a recording sheet, the image forming apparatus comprising an image forming unit that forms an image on a recording sheet at an image forming position; a regulation member that regulates a leading end of the recording sheet; a supply path for supplying the recording sheet passed through the regulation member to the image forming position; an inversion path that is configured to merge with a position on the supply path between the regulation member and the image forming position, the inversion path that inverts a course of the recording sheet by guiding the recording sheet conveyed from the image forming unit while bending the sheet and causing the recording sheet to merge with the supply path, thereby again guiding the inverted recording sheet to the supply path; and a return path for returning the recording sheet guided from the inversion path to the supply path to a side opposite to the supply path with respect to the regulation member.

According to another exemplary embodiment of the present invention, there is provided an image forming apparatus comprising an image forming unit disposed at an image forming position; a regulating roller provided upstream of the image forming position in a sheet conveyance direction; a supply path provided between the regulating roller and the image forming position; a loop path formation member provided downstream of the image forming position in the sheet conveyance direction; an inversion path provided from the loop path formation member to a position on the supply path that is downstream of the regulating roller and upstream of the image forming position in the sheet conveyance direction, a portion of the inversion path running parallel to the supply path; and a return path provided upstream, in the sheet conveyance direction, of the regulating roller.

According to the above exemplary embodiments, the inversion path intersects with a position in the supply path located between the regulating roller and the image forming position, and hence there is no need to position a mechanism for forming double-sided images in a space of a portion of the apparatus located upstream of the regulating roller. Therefore, a size of the apparatus may be reduced by using the space for other components.

The image forming apparatus of the present invention that can form an image on either side of a recording sheet enables effective use of an internal space of the apparatus.

BRIEF DESCRIPTION OF THE DRAWINGS

Illustrative aspects of the present invention will be described in detail with reference to the following figures wherein.

DETAILED DESCRIPTION OF EXEMPLARY EMBODIMENTS OF THE PRESENT INVENTION

First Exemplary Embodiment

<A Laser Printer>

Exemplary embodiments of the present invention will be described in detail by reference to the drawings.

Figure 1:
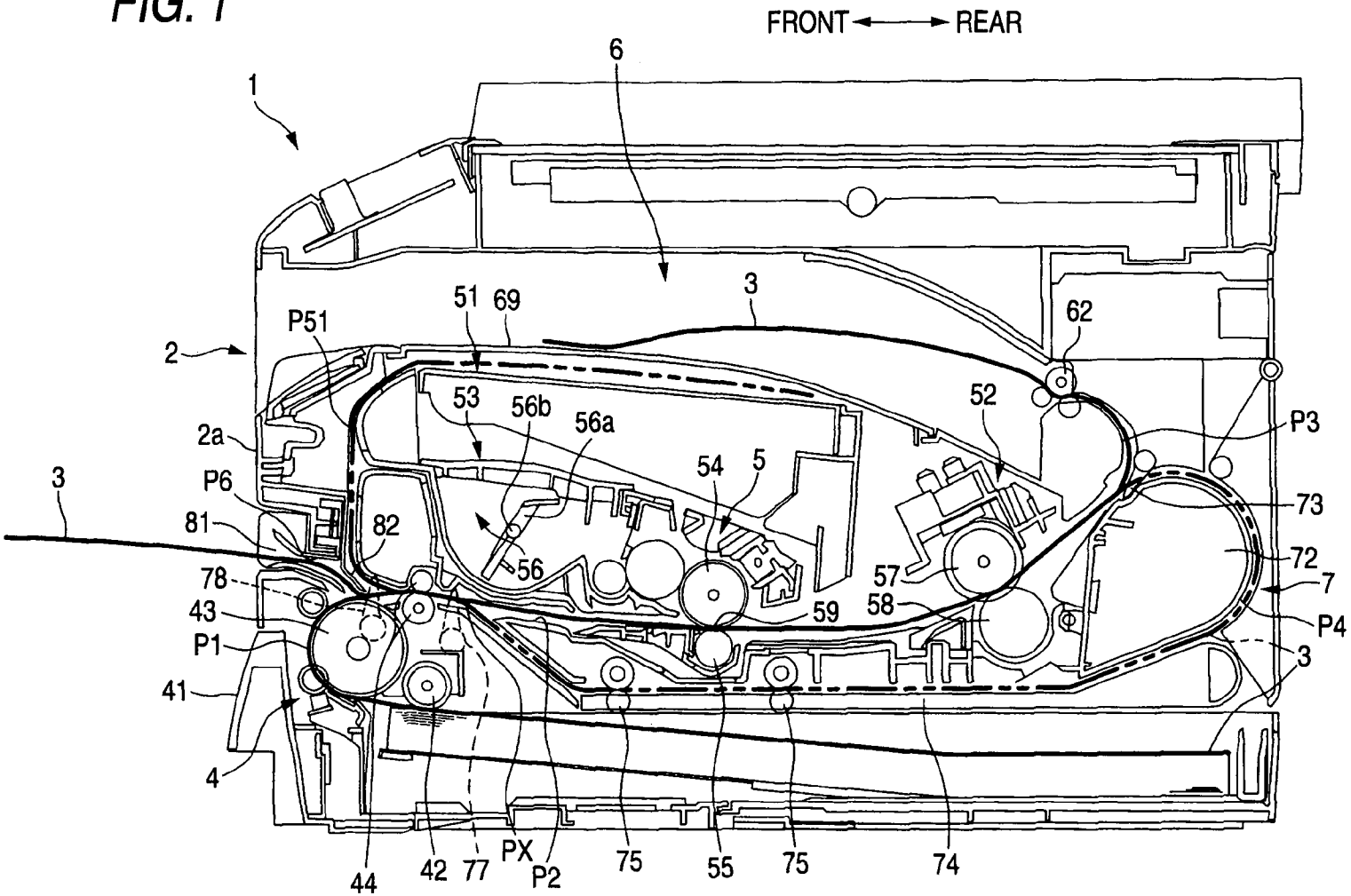
FIG. 1 is a cross-sectional view of an image forming apparatus according to a first exemplary embodiment of the present invention.

In the drawings, the left side of the page in FIG. 1 is taken as the front; the right side of the page in FIG. 1 is taken as the back; the top side of the page in FIG. 1 is taken as the upside; and the bottom of the page in FIG. 1 is taken as a downside.

As shown in FIG. 1, the laser printer 1 includes a feeder section 4 for feeding a sheet 3 serving as an example of a recording sheet fed in a main body casing 2; an image forming section 5 for forming an image on the sheet 3; a sheet discharging section 6 serving as an example recording sheet discharging section where the sheet 3, which has undergone image formation performed in the image forming section 5 and conveyed, is discharged and accumulated; and an inverted conveyance section 7 that conveys the sheet 3 whose front surface is printed to a position upstream of the image forming section 5 in order to subject the back side of the sheet 3 to printing.

Figure 2:
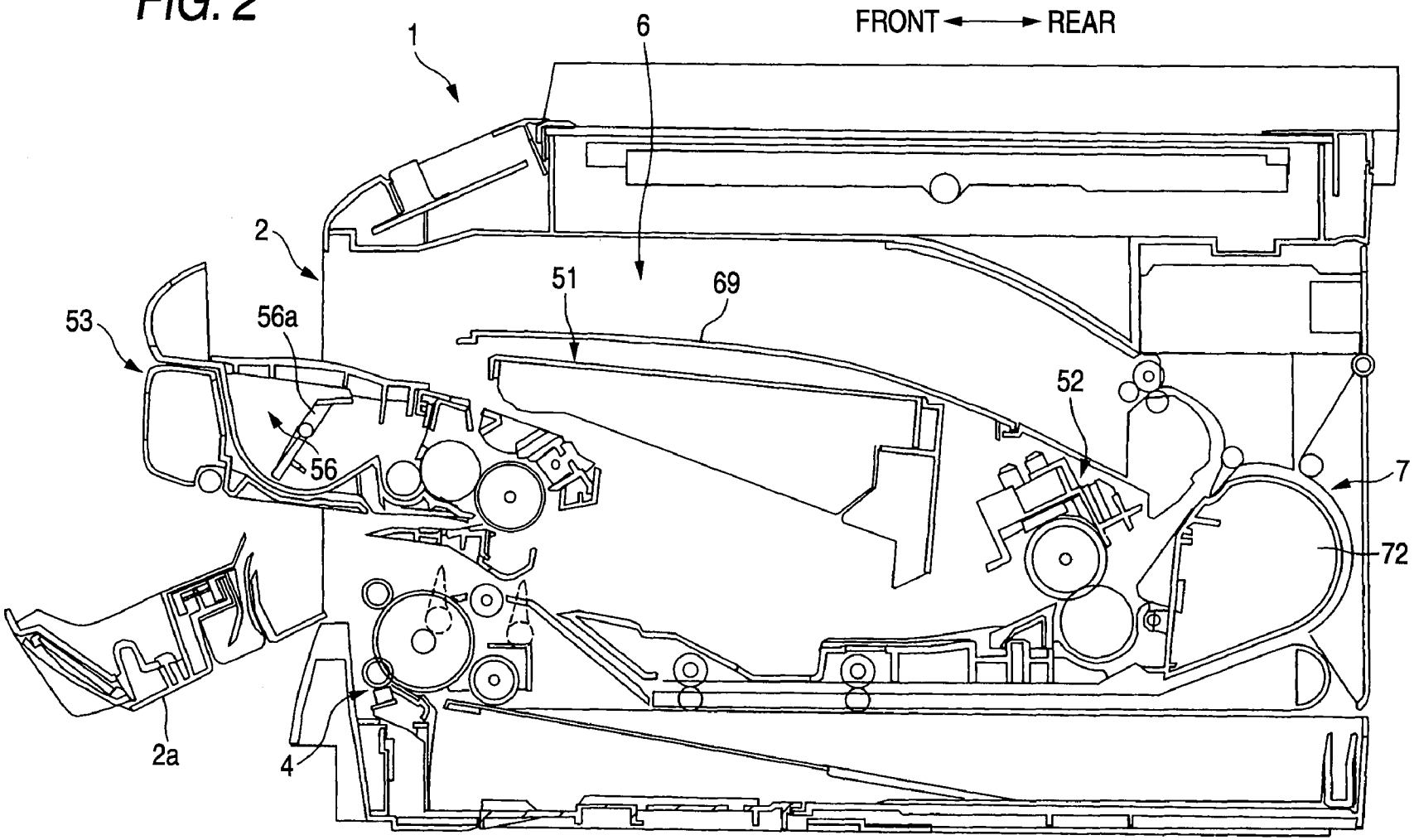
FIG. 2 is across-sectional view showing the image forming apparatus of FIG. 1 in a state in which a process cartridge is withdrawn from a main body casing.

A closeable front cover 2*a* is provided at the front of the main body casing 2. As shown in FIG. 2, a process cartridge 53 to be described later is detachably attached by way of an opening formed at the time of opening of the front cover 2*a*.

<Configuration of the Feeder Section>

The feeder section 4 includes a sheet feeding tray 41; a pickup roller 42; a sheet feeding roller 43; and a regulating roller 44 serving as an example regulating member.

The sheet feeding tray 41 is an example recording sheet accommodating section for housing the sheets 3 to be fed to the image forming section 5, and the sheets 3 are loaded in the sheet feeding tray.

A pickup roller 42 is a roller that is disposed at an elevated position in front of the sheets 3 in the sheet feeding tray 41 and that displaces and moves a top sheet of the sheets 3.

The sheet feeding roller 43 is disposed downstream of the pickup roller 42. The sheet feeding roller 43 is a roller that receives, on a lower side thereof, the sheet 3 conveyed forwardly by the pickup roller 42 and that orients a leading end serving as an example first end of the sheet 3 to the direction where the sheets 3 are loaded; namely, an upward direction in FIG. 1, and subsequently orients the leading end backward, thereby inverting a traveling direction of the sheet.

Throughout the specification, in relation to the "leading end" of the sheet 3 and a "trailing end" serving as an example second end of the sheet 3, a forward end of the sheet 3 is taken as a "leading end" and a rear end of the same is taken as a "trailing end" while a conveyance direction achieved when an image is formed on the front surface of the sheet 3 in the supply path P2 is taken as a reference, and the same locations achieved during reverse printing are also taken as the leading end and the trailing end. As is understood from the following descriptions, the sheet is conveyed along the supply path P2 during reverse printing operation while the trailing end of the sheet becomes a forward end.

The regulating roller 44 comprises two rollers located at an elevated position behind the sheet feeding roller 43. The lower regulating roller 44 is provided on a member, such as a frame, provided in the main body casing 2 of the laser printer 1, and the upper regulating roller 44 is provided on a process cartridge 53 to be described later. The regulating rollers 44 perform the function of correcting skewing of the sheet 3 as a result of the end of the fed sheet 3 contacting the regulating rollers 44. From the viewpoint of a positional relationship with the process cartridge 53, the regulating rollers 44 are disposed, along a supply path P2, upstream (forward) of a rotary shaft 56*b* of an agitator 56*a* for agitating a developing agent in the process cartridge 53.

The regulating rollers 44 are rotationally controlled by a control section 100, which will be described later, in a feed rotational direction for conveying the nipped sheet 3 toward a transfer position 59 serving as an example image forming position and a return rotational direction for conversely conveying the nipped sheet 3 toward a return path P51 serving as an example cartridge-side return path.

Namely, when rotationally controlled in the feed rotational direction, the regulating rollers 44 convey the sheet 3 from the front to the back in FIG. 1. When rotationally controlled in the return rotational direction, the regulating rollers 44 convey the sheet 3 from the back to the front in FIG. 1. The rotating direction may also be switched by means of switching of a gear. Alternatively, the regulating rollers 44 may also be driven by a forwardly-and-backwardly rotatable motor, and the rotating direction of the motor itself may also be switched.

<Configuration of the Image Forming Section>

The image forming section 5 includes the process cartridge 53 serving as an example cartridge, an exposure section 51, and a fixing section 52.

The process cartridge 53 is a section that has a photosensitive drum 54, a transfer roller 55, and a developing agent housing chamber 56 and that transfers a toner image formed on the photosensitive drum 54 to the sheet 3, thereby forming an image on the sheet 3. The photosensitive drum 54 and the transfer roller 55 rotate while contacting each other, thereby conveying the sheet 3 in a nipped manner. An area between the photosensitive drum 54 and the transfer roller 55, where the sheet 3 is nipped, corresponds to the transfer position 59. Toner serving as an example developing agent is housed in the developing agent housing chamber 56.

A path for the sheet 3 extending from the regulating roller 44 to the transfer position 59 is taken as the supply path P2.

The exposure section 51 is an example of an exposure unit, and is disposed on apart of the sheet discharging section 6 of the process cartridge 53. In other words, the exposure section 51 is disposed on an upper side of the process cartridge 53, and effects a high-speed scan of a laser beam over a surface of the photosensitive drum 54 by means of a known configuration.

The fixing section 52 is a section that is disposed behind the process cartridge 53 and that thermally fixes a developing agent on the sheet 3 where the image is formed. As is known, the fixing section 52 has a heating roller 57 and a pressing roller 58 that is disposed opposite the heating roller 57 and that nips the sheet 3 at a position between the heating roller 57 and the pressing roller 58. The heating roller 57 fuses the developing agent on the sheet 3 by means of heat, to thus fix the fused agent on the sheet 3, and conveys the sheet 3 backwardly.

<Configuration of the Sheet Discharging Section>

The sheet discharging section 6 includes a sheet discharging roller 62 and a sheet discharging tray 69. A discharging path P3 for guiding conveyance of the sheet 3 from the image forming section 5 to the sheet discharging section 6 is provided between the image forming section 5 and the sheet discharging section 6. The discharging path P3 is a path formed into the shape of the letter U that directs the leading end of the sheet 3 discharged from the imaging forming section 5 upwardly and further forwardly.

The sheet discharging tray 69 is a tray formed in an upper portion of the exposure section 51. The sheet 3 that has passed along the discharging path P3 and is discharged forwardly by the sheet discharging roller 62 is stacked on the sheet discharging tray 69.

<Configuration of the Inverted Conveyance Section>

An inversion path P4 is formed in the inverted conveyance section 7 and provided with a loop path formation member 72 and a path selector 73.

The inversion path P4 is a U-shaped path that extends backwardly, downwardly, and forwardly from a midpoint of the discharging path P3; runs below the image forming section 5; and merges with the supply path P2 at a junction PX between the regulating roller 44 and the transfer position 59.

Figure 3:
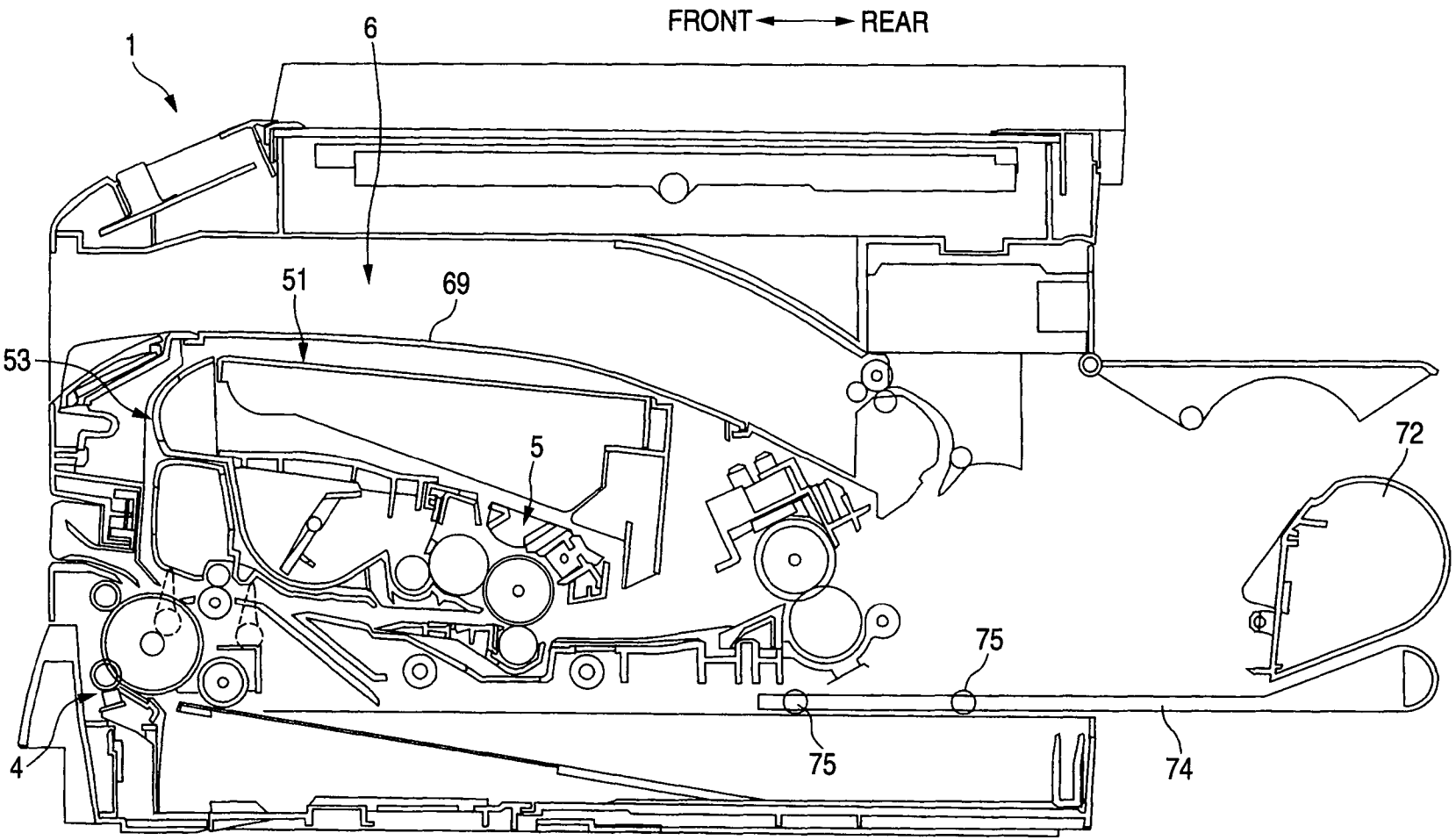
FIG. 3 is a cross-sectional view showing the image forming apparatus of FIG. 1 in a state in which a loop path formation member is withdrawn from the main body casing.

The loop path formation member 72 is a member that constitutes an inner wall of the U-shaped portion of the inversion path P4 and inverts the traveling direction of the sheet 3 by conveying the sheet 3 sent from the image forming section 5 while bending the same. The loop path formation member 72 is formed integrally with a lower wall 74 of the inversion path P4 and a portion of an inversion path conveyance roller 75 disposed in the inversion path P4. As shown in FIG. 3, the loop path formation member 72 can be removed from the back (a side downstream of the supply path P2) of the main body casing 2. Therefore, if the inversion path P4 becomes clogged with a sheet 3, the loop path formation member 72 may be pulled from the main body casing 2, so that the clogged sheet 3 can be readily removed.

The path selector 73 is disposed at a position where the discharge path P3 and the inversion path P4 are bifurcated. The path selector 73 is an arm whose upper end is supported by a member, such as a frame, in the main body casing 2 in a pivotable manner so as to be able to effect switching between a state in which the discharge path P3 is made passable and the inversion path P4 is closed (a state shown in FIG. 1) and a state in which the discharge path P3 is closed and the inversion path P4 is made passable (see FIG. 7B). The path selector 73 is driven by using a solenoid actuator and controlled so as to switch between the two states by means of the control section 100 to be described later.

The foregoing sheet feeding tray 41, the image forming section 5, and the sheet discharging section 6 are arranged in sequence from below. That is, the sheet feeding tray 41, the image forming section 5, and the sheet discharging section 6 are stacked in order on top of one another. The printer includes a feed path that bends the sheet 3 fed from the sheet feeding tray 41 at the front side surface part (one side surface part) of the main body casing 2, to thus invert the sheet, and that guides the thus-inverted sheet to the regulating rollers 44, and the discharge path P3 that inverts the sheet 3 conveyed from the image forming section 5 at a rear side surface part (the other side surface part) opposite to the front surface side of the main body casing 2 and that guides the thus-inverted sheet to the sheet discharging section 6.

Specifically, a conveyance path for the sheet 3 comprises a Z-shaped path along which the leading end of the loaded sheet 3 is directed toward a loading direction (an upward direction) at the front side surface part of the main body casing 2; along which the sheet is inverted by a sheet feeding mechanism, such as the pickup roller 42 and the sheet feeding roller 43; along which the sheet passes through the regulating rollers 44 and the image forming section 5; along which the sheet is subsequently inverted after the leading end of the sheet has been again directed toward the loading direction at the other side surface part (the rear side surface part) of the main body casing 2; and along which the sheet is discharged to the external sheet discharging tray 69.

Therefore, the sheet feeding tray 4, the image forming section 5, and the sheet discharging section 6, which serve as an example recording sheet accommodating section, are arranged so as to overlap each other when projected in the normal direction.

A downstream-side sensor 77 serving as an example of a first sensor and a third sensor for detecting passage of the sheet 3 is disposed at a position between the regulating rollers 44 and a junction PX between the inversion path P4 and the supply path P2; in other words, at a position on the supply path P2 downstream of the regulating rollers 44. By way of example, the downstream sensor 77 can be configured and arranged in such a way that the sheet 3 contacts the upper end of a pivotal arm and that motion of the pivotal arm is detected by an unillustrated optical sensor. Specifically, the downstream sensor 77 detects whether or not the sheet 3 is present at the position where the downstream sensor 77 is disposed. Passage of the end of the sheet 3 can be determined by means of switching of a detection result.

The return path P51 is formed so as to extend from the front side of the regulating rollers 44 along a front surface of the process cartridge 53 and an upper surface of the exposure section 51. To put it another way, the return path P51 is formed on the front side surface part of the process cartridge 53 and the front side surface part of the exposure section 51 and further on the exposure section 51. The return path P51 is a path for, if the sheet 3 is subjected to reverse printing, temporarily returning from the inversion path P4 the sheet 3 passed through the regulating rollers 44 and causing the sheet to pass. The return path P51 of the present exemplary embodiment is arranged so as to run along the front side of the process cartridge 53 and the upper side of the exposure section 51. A size of the laser printer 1 is able to be reduced by effectively using a gap of the printer.

An upstream sensor 78 serving as a second sensor for detecting passage of the sheet 3 is provided above the return path P51; namely, at the immediate front of the regulating rollers 44. The upstream-side sensor 78 can be provided with a similar configuration to that of the downstream sensor 77. An optical sensor for directly detecting widthwise ends (achieved along the depthwise of the sheet of FIG. 1) of the sheet 3 by means of light may also be adopted as the downstream sensor 77 and/or the upstream sensor 78.

The upstream sensor 78 is used for determining a timing when the regulating rollers 44 are rotated in the feed rotational direction. For instance, when the leading end of the sheet 3 is detected by the upstream sensor 78, control is performed in such a way that the regulating rollers 44 rotate in the feed rotational direction at a timing on the basis of a detection result. The timing may be predetermined. Thus, the sheet 3 contacts the stationary regulating rollers 44, whereupon skewing of the sheet is regulated, and the sheet is then fed to the transfer position 59.

Moreover, the downstream sensor 77 is used for determining timing of exposure. For instance, if the downstream sensor 77 detects the leading end of the sheet 3 sent to the regulating rollers 44 that are rotating in the feed rotational direction, the exposure section 51 is controlled so as to start exposure at a timing on the basis of a result of detection. The timing may be predetermined. In the present exemplary embodiment, such an upstream sensor 78 and a downstream sensor 77 double as various sensors for the laser printer 1, and hence the configuration of the printer becomes simple.

A manual sheet supply path P6 is further formed at the front of the regulating rollers 44. The manual sheet supply path P6 is in communication with a manual feed port 81 formed in the front side of the main body casing 2. The manual sheet supply path P6 merges with the feed path P1 at a position above the sheet feeding roller 43 and is in communication with the regulating rollers 44. A guide wall 82 that extends downwardly with increasing distance in the backward direction is formed at the rear of the manual feed port 81. A lower end of the guide wall 82 is situated at a position slightly below a plane at which the regulating rollers 44 nip the sheet 3. Therefore, the sheet 3 fed from the manual sheet supply path P6 is fed to the regulating rollers 44, but the sheet 3 returned forwardly from the regulating rollers 44 collides against the back of the guide wall 82 and is conveyed to the upwardly-extending return path P51.

The control section 100 controls driving of the foregoing feeder section 4, the image forming section 5, the sheet discharging roller 62, the inverted conveyance section 7, and respective sections whose detailed explanations are omitted. The control section 100 has a CPU that performs arithmetic operation, data transfer, and other operations; a volatile storage device; a nonvolatile storage device; and the like. The control section controls respective sections in accordance with a previously-stored program.

Figure 4:
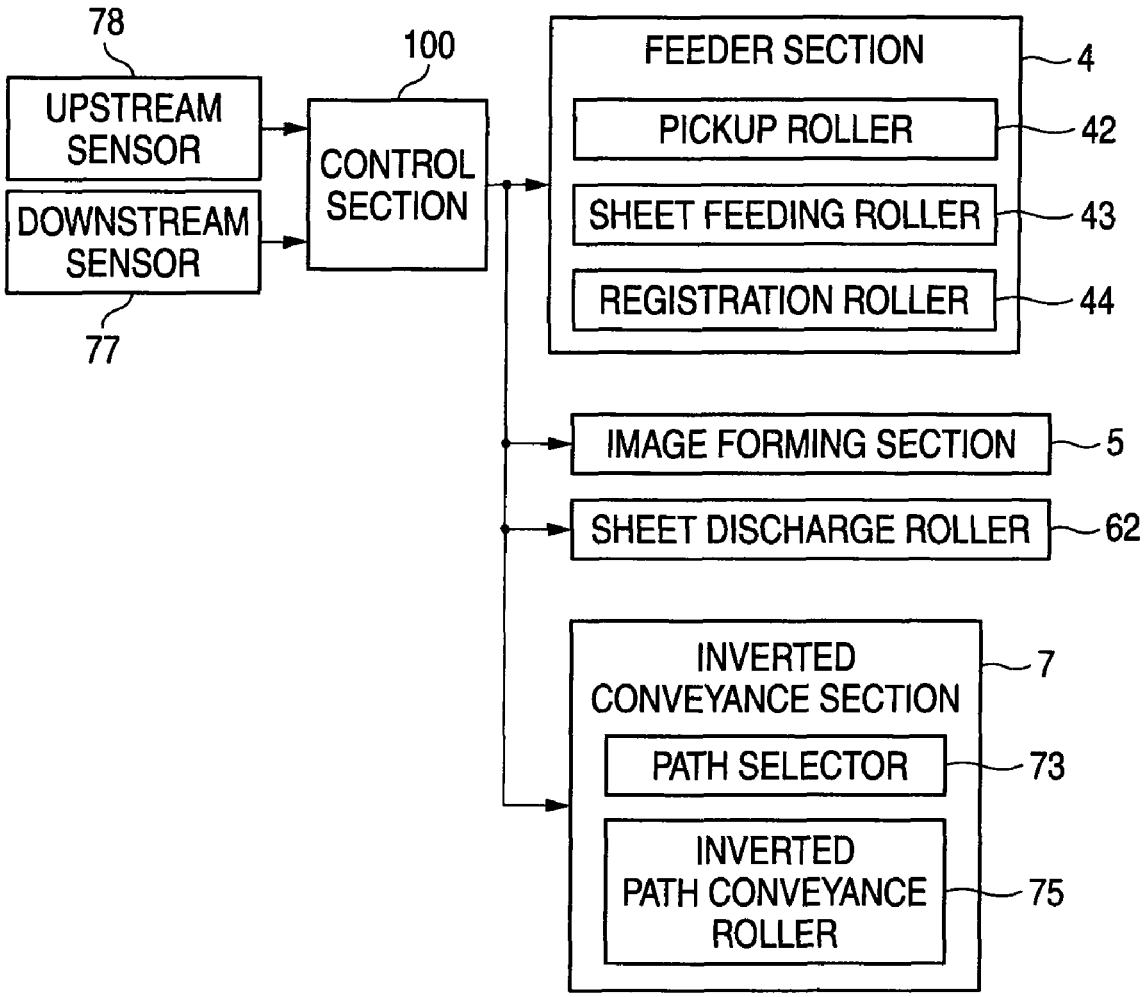
FIG. 4 is a block diagram of the image forming apparatus according to the first exemplary embodiment.

As can be seen from a block diagram shown in FIG. 4, the control section 100 controls the feeder section 4, the image forming section 5, the sheet discharging roller 62, and the inverted conveyance section 7 on the basis of results of detection performed by the downstream sensor 77 and the upstream sensor 78, thereby conveying the sheet 3.

Figure 5:
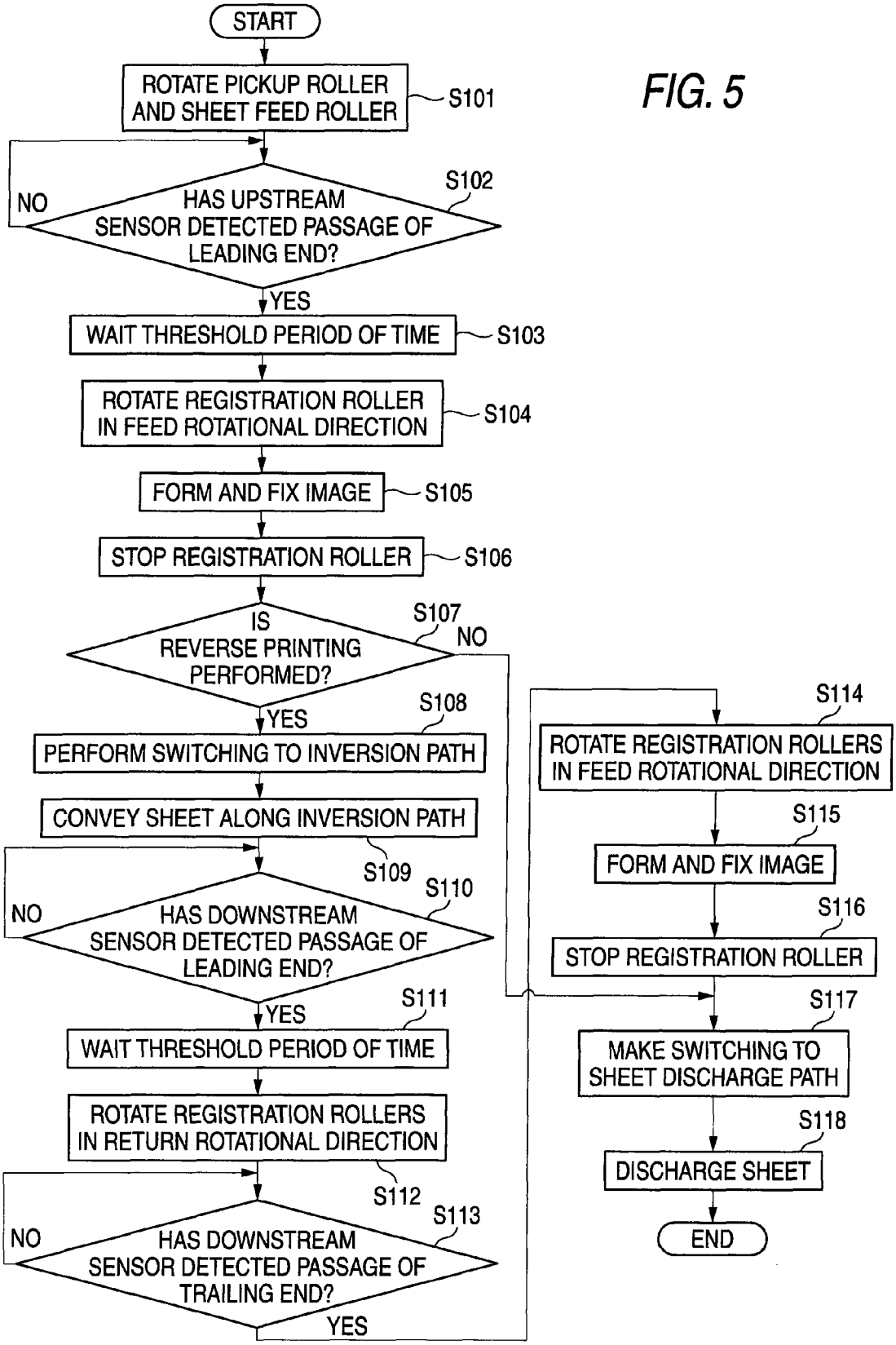
FIG. 5 is a flowchart showing a sheet conveyance process according to the first exemplary embodiment of the present invention.
Figure 6:
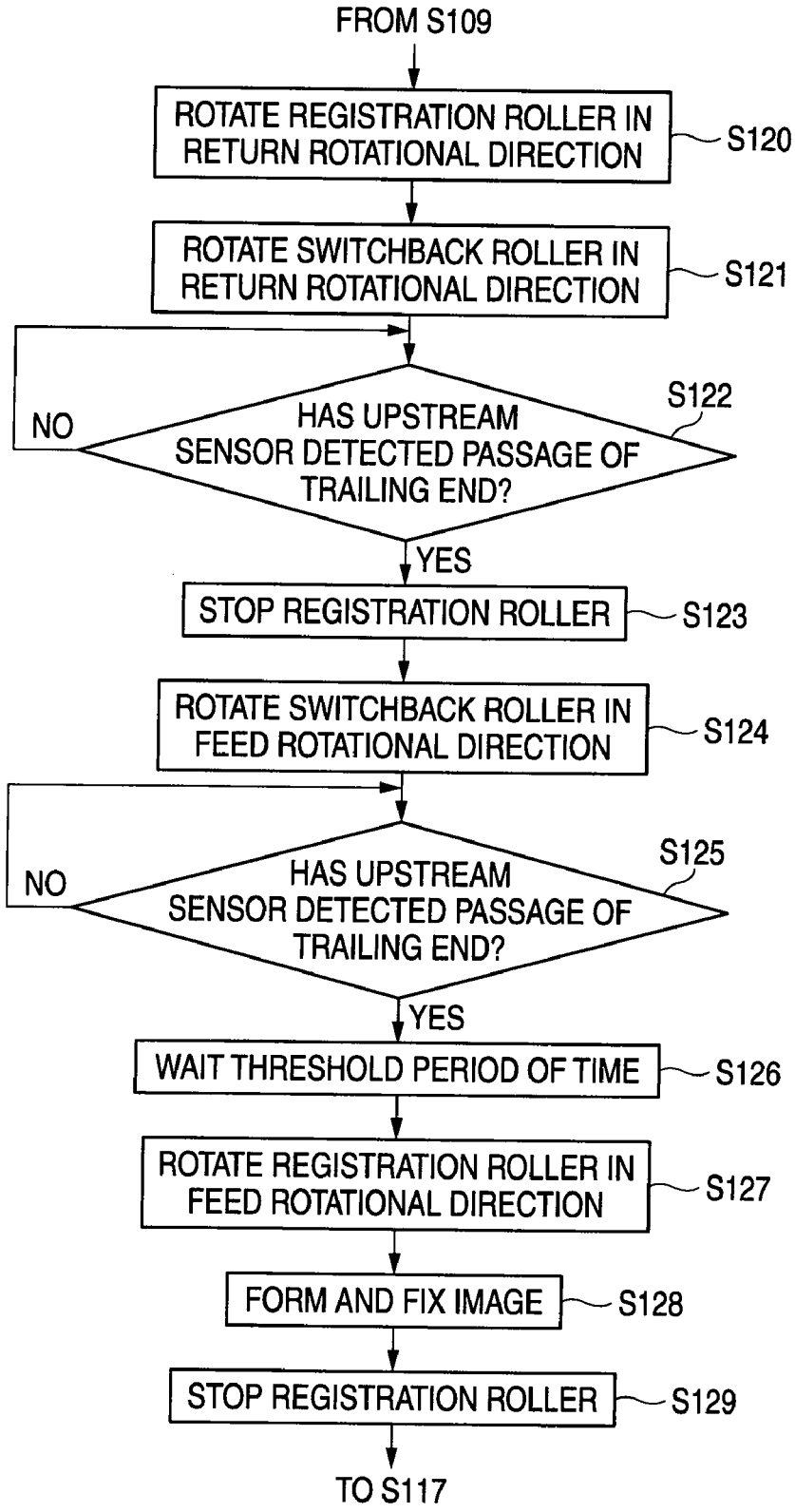
FIG. 6 is a flowchart showing a conveyance process according to a modification of the first exemplary embodiment.

Control of conveyance of the sheet 3 performed by the control section 100 is described by reference to flowcharts of FIGS. 5 and 6. FIG. 5 is a flowchart of sheet conveyance processing performed by the laser printer according to the first exemplary embodiment. FIG. 6 is a flowchart of conveyance processing according to a modification of the first exemplary embodiment; and FIGS. 7 through 10 are cross-sectional views showing the state of conveyance of the sheet 3.

The control section 100 conveys the sheet 3 upon receipt of a print job from another device coupled to the laser printer 1. The print job includes a command for performing double-sided printing operation.

As shown in FIG. 5, first the control section 100 rotates the pickup roller 42 and the sheet feeding roller 43 (S101), thereby raising the sheet 3 in a known manner to bring the top sheet 3 into contact with the pickup roller 42. Thus, a single top sheet 3 is moved forward from the sheet feeding tray. The sheet feeding roller 43 bends the leading end of the sheet 3 upward and backward, thereby conveying the sheet 3 toward the regulating rollers 44. At this time, the control section 100 stops the regulating rollers 44.

When the leading end of the sheet 3 moves toward the regulating rollers 44, the leading end of the sheet 3 contacts the upstream sensor 78. It is then determined whether the upstream sensor 78 has detected the passage of the leading end of the sheet 3 at operation S102. If it is determined that the upstream sensor 78 has not detected the passage of the leading end of the sheet 3 (NO in S102), the process returns to operation S102. If it is determined that the upstream sensor 78 detects passage of the leading end of the sheet 3 (YES in S102), the control section 100 waits a threshold period of time (S103) and rotates the regulating rollers 44 in a feed rotational direction (S104). The threshold period of time is longer than a period from when the leading end of the sheet 3 is detected by the upstream sensor 78 until when the leading end contacts the regulating rollers 44. As a result, after the leading end of the sheet 3 has contacted the stationary regulating rollers 44 for a very short period of time, the sheet is conveyed by the regulating rollers 44. Thus, as a result of the leading end of the sheet 3 contacting the stationary regulating rollers 44, skewing of the sheet 3 is corrected.

Figure 7A:
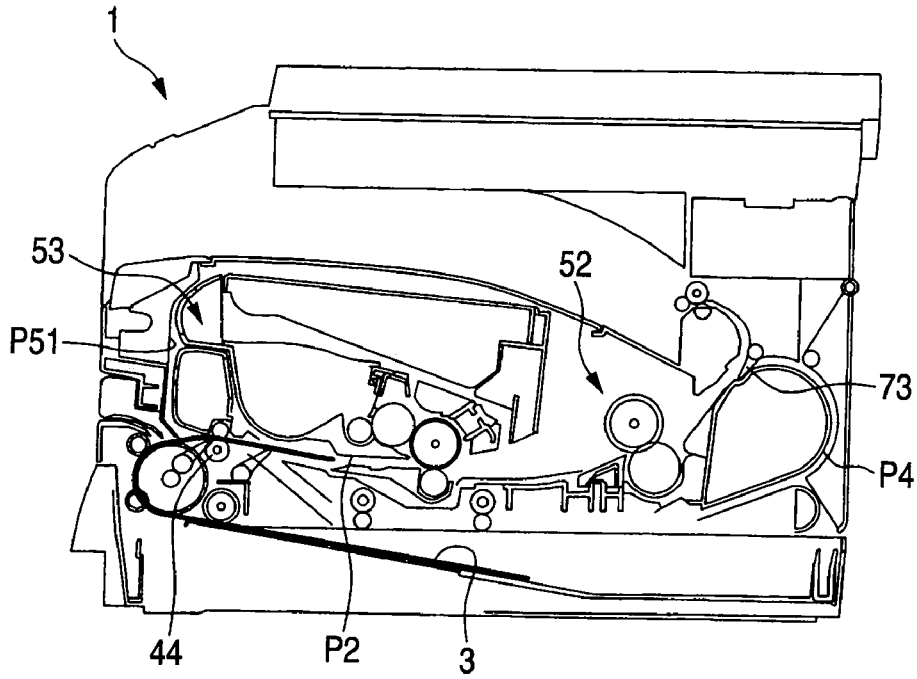
FIG. 7A is a cross-sectional view of an image forming apparatus showing a state in which a sheet is fed to a transfer position.

The sheet 3 is conveyed toward the transfer position 59 along the supply path P2 by means of rotation of the regulating rollers 44 in the feed rotational direction (see FIG. 7A). When the sheet 3 arrives at the transfer position, a toner image is transferred onto the surface of the sheet 3 at that transfer position, and the toner image is fixed to the sheet 3 by means of the fixing section 52 (S105). The control section 100 stops the regulating rollers 44 (S106). Stoppage of the regulating rollers 44 may be performed at any appropriate timing, so long as stoppage is performed at appropriate timing achieved after completion of conveyance of the sheet 3 from the regulating rollers 44 to the transfer position 59 for forming an image on the surface of the sheet 3. For instance, when passage of the trailing end of the sheet 3 is detected by the downstream sensor 77, rotation of the regulating rollers 44 may also be stopped.

Subsequently, it is determined whether printing on the back side of the sheet 3 is to be performed at operation S107. If it is determined that printing is not to be performed on the back side of the sheet 3 (NO in S107), the path selector 73 is switched to the discharging path P3 (S117), thereby discharging a printed sheet 3 to the sheet discharging tray 69 (S118).

Figure 7B:
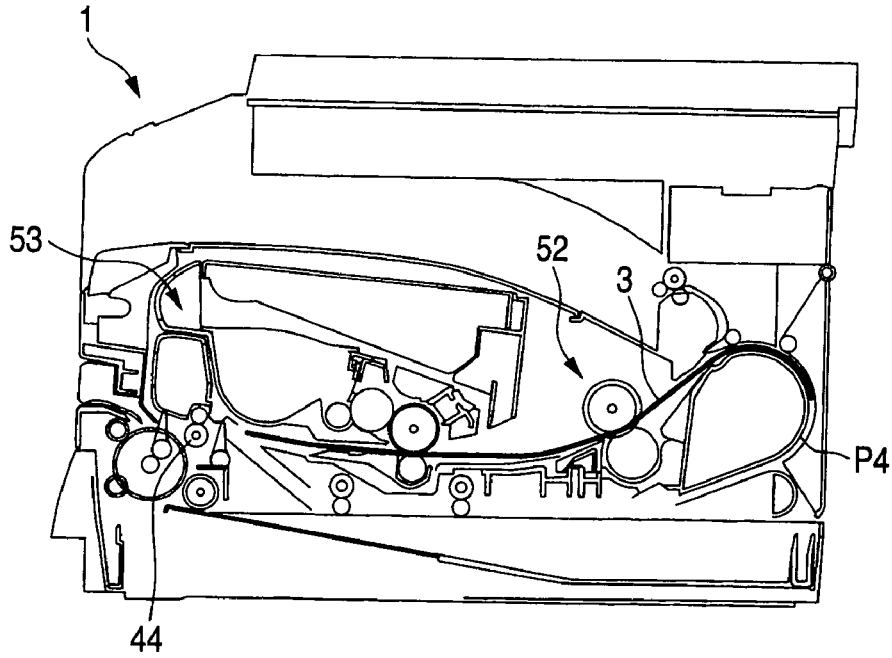
FIG. 7B is a cross-sectional view of the image forming apparatus showing a state in which the sheet has entered an inversion path.
Figure 8A:
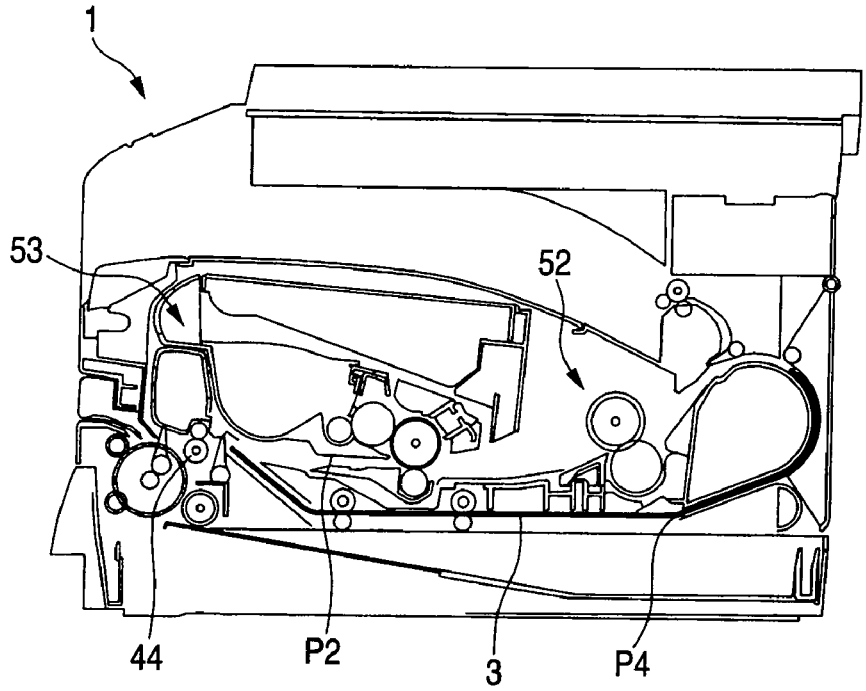
FIG. 8A is a cross-sectional view of the image forming apparatus of FIGS. 7A and 7B showing a state in which a leading end of an inverted sheet has entered a supply path.
Figure 8B:
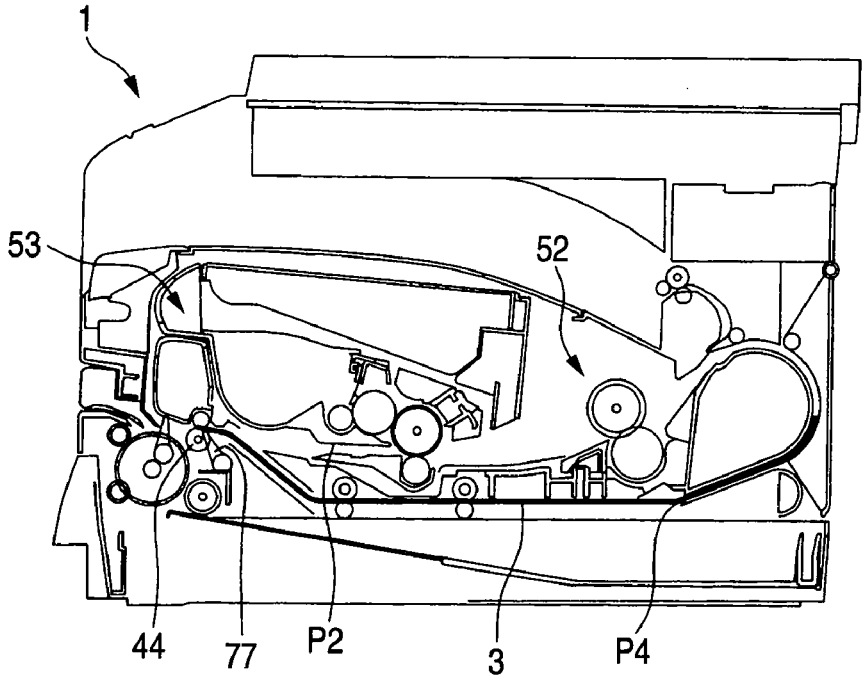
FIG. 8B is a cross-sectional view of the image forming apparatus showing a state in which the leading end of the sheet has collided against a downstream sensor and regulating rollers.
Figure 9:
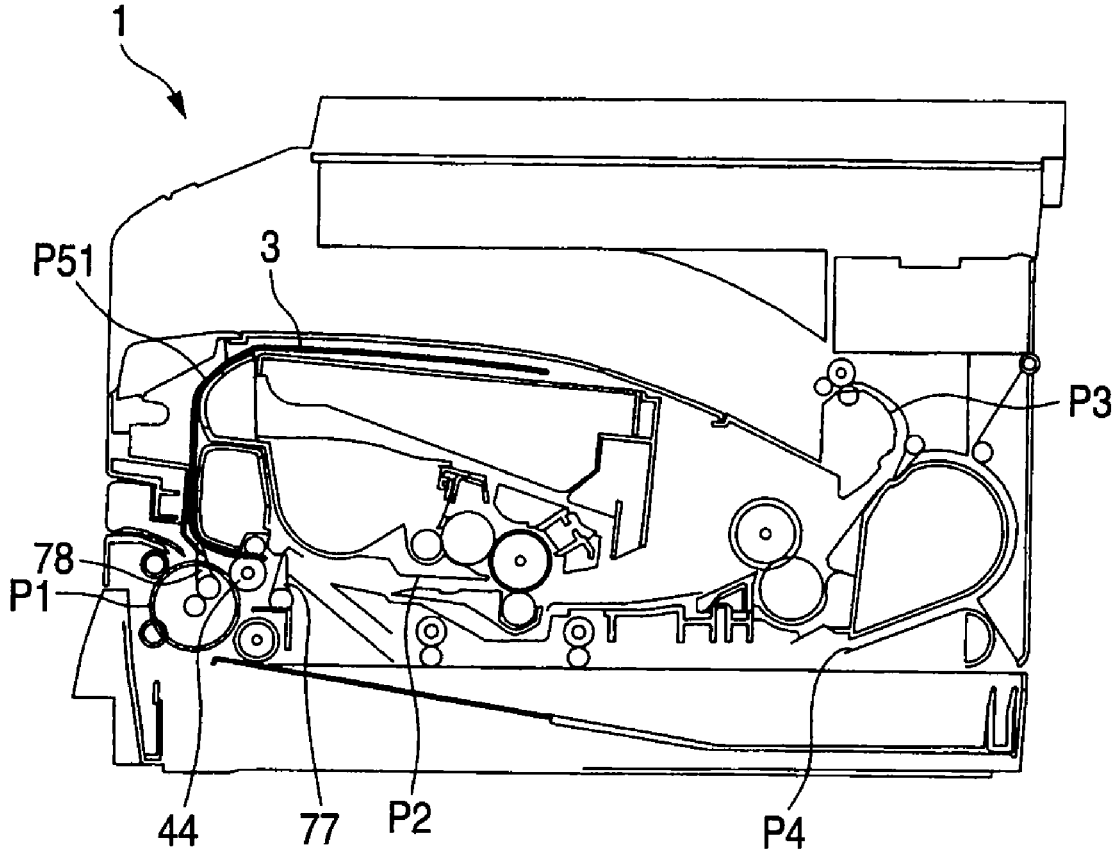
FIG. 9 is a cross-sectional view of the image forming apparatus of FIGS. 8A and 8B showing a state in which the sheet is in a return path.

If it is determined that printing is to be performed on the back side of the sheet 3 (YES in S107), the path selector 73 is switched to the inversion path P4 (S108), thereby conveying the sheet 3 to the inversion path P4 (S109 and see FIG. 7B). The direction of the leading end of the sheet 3 is changed downwardly and further forwardly at the rear of the main body casing 2 along the inversion path P4. The control section 100 drives the inversion path conveyance roller 75, thereby conveying the sheet 3 from the inversion path P4 to the supply path P2. The sheet 3 is guided to the supply path P2 by means of the junction PX located between the regulating rollers 44 and the transfer position 59 (see FIG. 8A).

It is then determined whether the downstream sensor 77 detects the passage of the leading end of the sheet 3. If it is determined that the downstream sensor 77 detects passage of the leading end of the sheet 3 (YES in S110), the control section 100 waits a threshold period of time (S111) and rotates the regulating rollers 44 in the return rotational direction (S112 and see FIG. 8B). The threshold period of time is longer than a period from when the leading end of the sheet 3 is detected by the downstream sensor 77 until when the leading end contacts the regulating rollers 44. As a result, after the leading end of the sheet 3 has contacted the stationary regulating rollers 44 for a very short period of time, the sheet is conveyed by the regulating rollers 44, and hence skewing of the sheet 3 is corrected.

Although the trailing end of the sheet 3 is detected by the downstream sensor 77, the sheet is detected after merging with the path at the junction PX in the present exemplary embodiment, whereby the behavior of the sheet 3 becomes stable and the trailing end of the sheet can be detected accurately.

Next, the sheet 3 is drawn into the return path P51 by means of rotation of the regulating rollers 44. It is then determined whether the downstream sensor 77 detects the passage of the trailing end of the sheet 3 at operation S113. If it is determined that the downstream sensor 77 detects the trailing end (YES in S113 and see FIG. 9), the control section 100 rotates the regulating rollers 44 in the feed rotational direction (S114) As a result, the sheet 3 is fed to the image forming section 5 by way of the supply path P2; an image is formed and fixed on the back side of the sheet (S115); and the regulating rollers 44 are stopped (S116).

The control section 100 proceeds to step S117, where the sheet is discharged (S117 and S118), and completes processing.

Thus, even when the inversion path P4 and the supply path P2 merge with each other at the position between the regulating rollers 44 and the transfer position 59 as in the embodiment, double-sided printing is possible. After the leading end of the sheet 3 returned from the inversion path P4 to the supply path P2 has been brought into contact with the stationary regulating rollers 44 before reverse printing of the sheet, the sheet 3 is drawn into the return path P51, so that skewing of the sheet 3 can be corrected. According to the control operation, the entire sheet 3 does not need to be moved toward the return path P51 in excess of the regulating rollers 44, and hence a time used to perform double-sided printing becomes shorter, so that double-sided printing can be performed swiftly. According to the laser printer 1 according to the present exemplary embodiment of the present invention, the upstream side (the front side) of the regulating rollers 44 does not need to be used for merging of the inversion path P4 with the feed path P1, and hence the longitudinal dimension of the laser printer 1 can be reduced.

In the laser printer 1 of the present exemplary embodiment, the sheet feeding tray 41, the image forming section 5, and the sheet discharging section 6 are arranged in sequence from below as an example of the recording sheet accommodating section. Hence, the conveyance path for the sheet 3 is folded in an essentially-Z-shaped pattern, so that the laser printer 1 can be miniaturized in a vertical direction.

Incidentally, the feed path P1 for the sheet 3 from the sheet feeding tray 41 to the regulating rollers 44 is curved in a comparatively-tight manner. Hence, if the inversion path P4 is merged with the feed path P1 at a point that is located upstream of the regulating rollers 44, the sheet 3 must be bent more tightly in the neighborhood of the junction section PX. Hence, adoption of such a form may induce clogging of the sheet 3.

Accordingly, exemplary embodiments of the present invention adopt the configuration in which the inversion path P4 is merged with the supply path P2 between the regulating rollers 44 and the transfer position 59, whereby the sheet 3 is not bent tightly and clogging of the sheet 3 is prevented. Further, the size of the printer is able to be reduced by the more effective use of space.

In the printer having such an Z-shaped sheet conveyance path, the cartridge is configured so as to be removably attached from a direction opposite to the fixing section 52; in other words, a direction opposite to the supply path P2 with the return path P51 sandwiched therebetween; and, put another way, a side of the laser printer 1 where the return path P51 of the process cartridge 53 is formed. Hence, the printer can be miniaturized by effective use of space. When the return path P51 is formed on the removable attachment side of the main body casing 2 by means of such a configuration, the space can be used more effectively. Moreover, the side to which the process cartridge 53 is removably attached and the side of the process cartridge 53 where the return path P51 is formed are identical with each other. Hence, if the return path P51 becomes clogged with a sheet 3, the paper jam is easily removed by uncovering the return path P51.

In the exemplary embodiments, the return path P51 is arranged so as to run along the front side of the process cartridge 53 and the upper side of the exposure section 51. Hence, a size of laser printer 1 may be decreased by more effectively using a gap in the printer.

In the exemplary embodiments, the regulating rollers 44 are disposed at upstream positions in the supply path P2 with reference to the rotary shaft 56*b* of the agitator 56*a*. Hence, there is no need for space for the regulating rollers at positions immediately below the process cartridge 53; in particular, downstream positions in the supply path P2 with respect to the rotary shaft 56*b* of the agitator 56*a*, so that an increase in vertical size of the laser printer 1 can be prevented.

In the exemplary embodiments, the loop path formation member 72 can be withdrawn from the back of the main body casing 2. Therefore, if the inversion path P4 becomes clogged with a sheet 3, the loop path formation member 72 may be withdrawn from the main body casing 2, thereby enabling easy removal of the clogged sheet 3.

Modification of First Exemplary Embodiment

In the modification of the first exemplary embodiment, switchback rollers are added to the printer of the first exemplary embodiment and a method for controlling sheet conveyance is changed. Referring to FIG. 5, the regulating rollers 44 are reversely rotated from the return rotational direction to the feed rotational direction while the sheet 3 is nipped between the regulating rollers 44 after being inverted, thereby again conveying the sheet 3 to the supply path P2. However, in the first modification of the first embodiment, there will be described a case where, after the entire sheet 3 has been moved to the return path P51 from the regulating rollers 44, the sheet 3 is again conveyed to the supply path P2.

Figure 10:
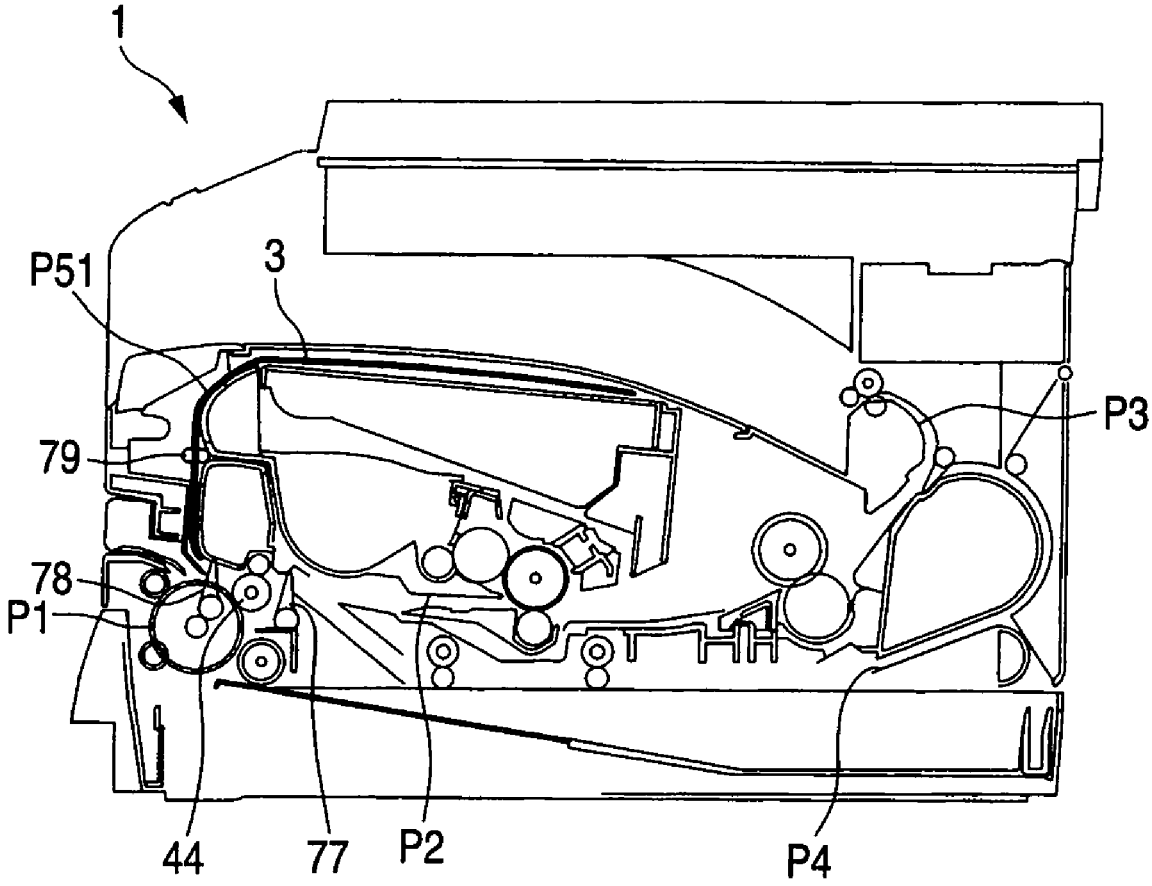
FIG. 10 is a cross-sectional view of the image forming apparatus showing a modification of the first exemplary embodiment including a modified state in which the sheet is in the return path.

In the first modification of the first exemplary embodiment, as shown in FIG. 10, a roller for conveying the sheet 3 is further disposed along the return path P51. Specifically, switchback rollers 79 are disposed along the return path P51 and forward of the process cartridge 53. The switchback rollers 79 are conveyance rollers that withdraw the sheet 3 conveyed to the return path P51 further inside thereof or conversely feed the sheet from the return path P51 again to the supply path P2. Rotation of the switchback rollers 79 is controlled by the control section 100. As in the case of the regulating rollers 44, the switchback rollers 79 are switched between a feed rotational direction in which the sheet 3 is conveyed from the return path P51 toward the supply path P2 and the return rotational direction in which the sheet 3 is conveyed from the supply path P2 toward the return path P51.

In the first modification of the first exemplary embodiment, the inverted sheet 3 is sequentially fed to the inversion path P4, the supply path P2, and the return path P51. After the trailing end of the sheet 3 has passed the regulating rollers 44, rotation of the regulating rollers 44 is stopped, and rotation of the switchback rollers 79 is inverted, whereby the sheet 3 is conveyed toward the regulating rollers 44. The expression "rotation of the regulating rollers 44 is stopped and rotation of the switchback rollers 79 is inverted" may also mean that stoppage and inversion are performed simultaneously or that a time interval may be present between stoppage and inversion.

As shown in FIG. 6, in the first modification of the first exemplary embodiment, the control section 100 conveys the sheet 3 to the inversion path P4 for printing of a back sheet (from S109) and rotates the regulating rollers 44 at predetermined timing in the return rotational direction (S120). The timing may also come before the leading end of the sheet 3 arrives at the regulating rollers 44 or immediately after arrival of the leading end at the regulating rollers.

In addition to rotating the regulating rollers 44 in the return rotational direction, the control section 100 rotates the switchback rollers 79 in the return rotational direction (S121) and conveys the sheet 3 to the return path P51. The control section 100 determines whether the upstream sensor 78 has detected passage of the trailing end of the sheet 3 in operation S122. If it is determined that the upstream sensor 78 has not detected the trailing end (NO in S122), the process returns to S122. If it is determined that the upstream sensor 78 has detected the trailing end (YES in S122), the entirety of the sheet 3 has moved toward the return path P51 from the regulating rollers 44. Hence, the control section 100 stops the regulating rollers 44 (S123) and rotates the switchback roller 79 in the feed rotational direction (S124). As a result, the sheet 3 starts moving toward the regulating rollers 44 while the trailing end of the sheet is oriented ahead. It is then determined whether the upstream sensor 7B detects passage of the trailing end of the sheet 3 in operation S125. If it is determined that the upstream sensor 78 does not detect passage of the trailing end (NO in S125), the process returns to operation S125. If it is determined that the upstream sensor 78 detects passage of the trailing end (YES in S125), the control section 100 waits a threshold period of time (S126) and rotates the regulating rollers 44 in the feed rotational direction (S127). The sheet 3 is fed to the image forming section 5 by way of the supply path P2 as in the case of printing of the front side of the sheet; an image is formed and fixed on the back side of the sheet (S128); and the regulating rollers 44 are stopped (S129). As in the case of the foregoing basic pattern, the control section 100 proceeds to operation S117 shown in FIG. 5, where the sheet is discharged (S117 and S118), and completes processing.

As mentioned above, the return path P51 is provided with the switchback rollers 79, and the entirety of the sheet 3 is once conveyed to the side of the regulating rollers 44 facing the return path P51, whereby the sheet 3 can be again fed to the transfer position 59 even during reverse printing just as in the case of printing of the front side.

In addition to the basic pattern and the modification mentioned above, the method for controlling conveyance of the sheet 3 can be carried out while being modified. For instance, in the basic pattern, the regulating rollers 44 are reversely rotated in the feed rotational direction after the trailing end of the sheet 3 passes the downstream sensor 77. However, the regulating rollers 44 may also be reversely rotated in the feed rotational direction after an elapse of a threshold period of time after the downstream sensor 77 or the upstream sensor 78 detects passage of the front end of the sheet 3. Even in this case, the size of the sheet 3 has already been acquired by means of a print job, and hence it is advantageous to set a threshold time according to the size of the sheet 3. As a result, the regulating rollers 44 can be reversely rotated in the feed rotational direction after the trailing end of the sheet 3 has arrived at the supply path P2. The sheet 3 can be normally fed to the transfer position 59 for reverse printing.

In the modification of the first exemplary embodiment, a registration gate may also be used in lieu of the regulating rollers 44. The registration gate is a member that is supported at a position along the recording sheet conveyance path so as to be swingable between a position in which the gate contacts the leading end of the recording sheet and a receded position. Upon contacting the leading end of the recording sheet, the registration gate causes the recording sheet to recede to the receded position while correcting skewing of the leading end of the recording sheet. Thus, the recording sheet can pass the registration gate while skewing of the recording sheet is regulated.

Likewise, in the modification of the first exemplary embodiment, the switchback rollers 79 are reversely rotated in the feed rotational direction on condition that the upstream sensor 78 has detected the trailing end of the sheet 3. However, the switchback rollers 79 may also be reversely rotated in the feed rotational direction after elapse of a threshold period of time after the downstream sensor 77 has detected passage of the leading or trailing end of the sheet 3 or after the upstream sensor 78 has detected passage of the leading end of the sheet 3.

Second Exemplary Embodiment

Figure 11:
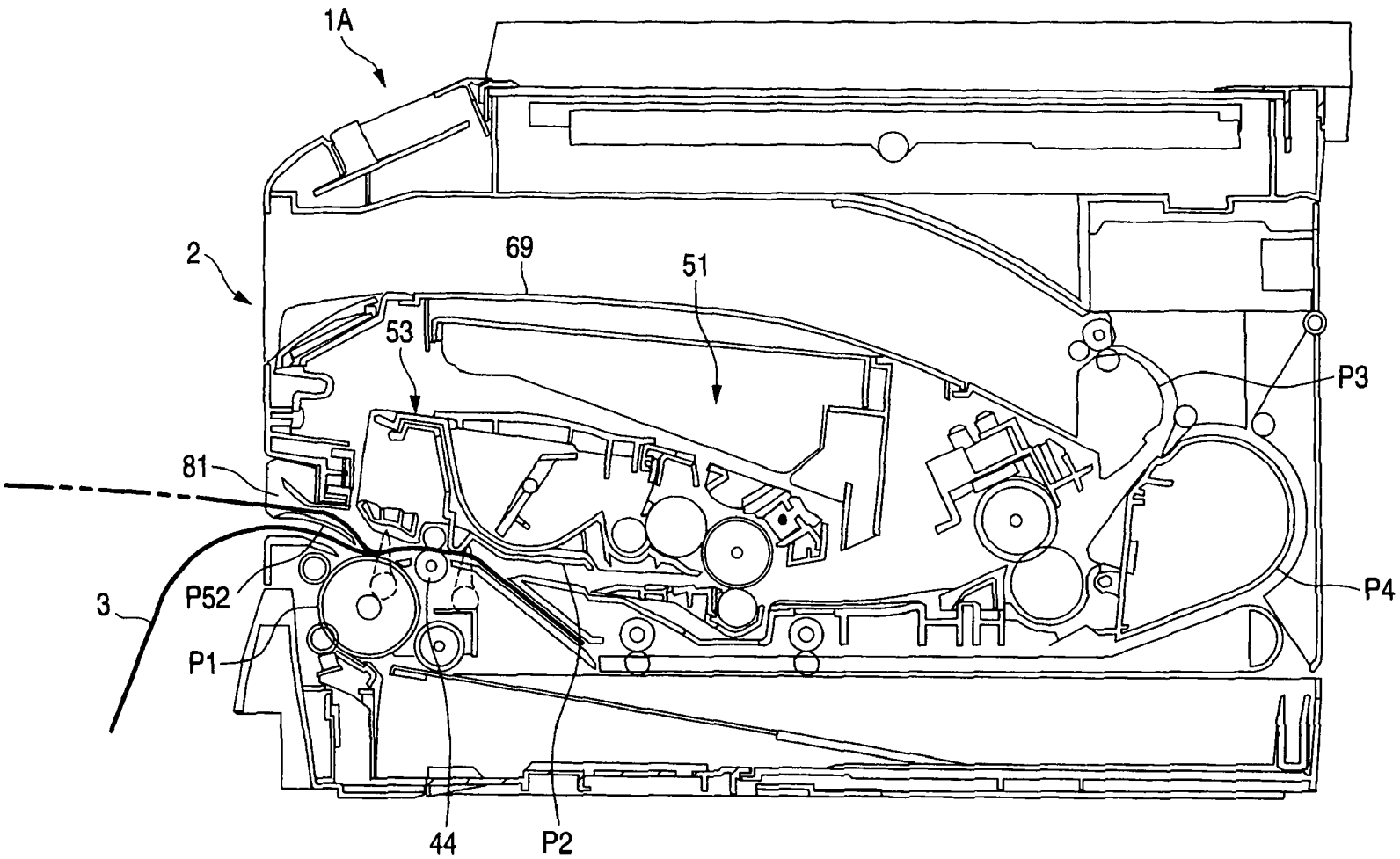
FIG. 11 is a cross-sectional view of an image forming apparatus according to a second exemplary embodiment of the present invention.
Figure 12A:
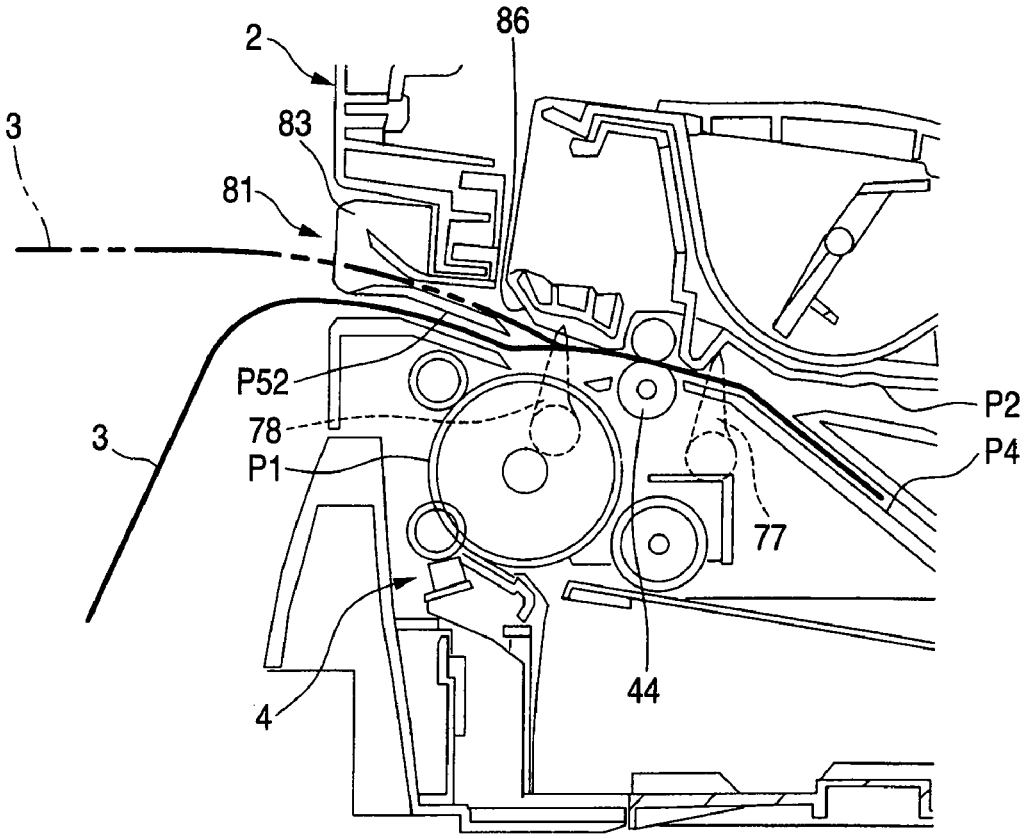
FIG. 12A is an enlarged cross-sectional view of a manual sheet feed unit of the image forming apparatus of FIG. 11.
Figure 12B:
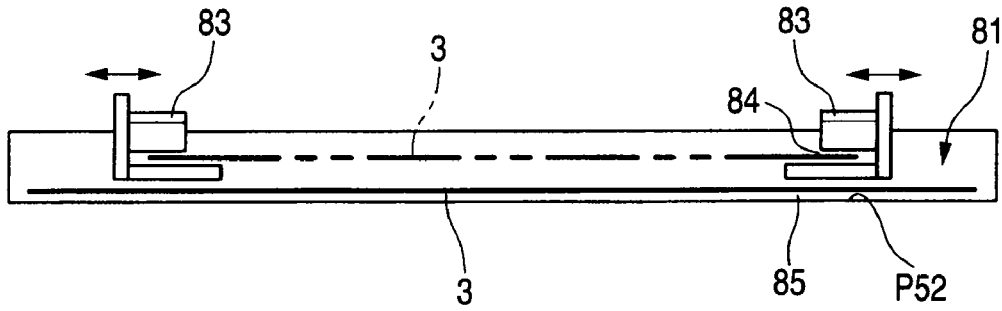
FIG. 12B is view of the manual sheet feed unit when viewed from the front.

A second exemplary embodiment of the present invention will now be described. FIG. 11 is a cross-sectional view of a laser printer according to a second exemplary embodiment. FIG. 12A is an enlarged cross-sectional view of a manual sheet feeding section, and FIG. 12B is a view of the manual sheet feeding section when viewed from the front. In relation to the second exemplary embodiment, explanations are provided only with respect to the differences between the first and second exemplary embodiments.

As shown in FIG. 11, a laser printer 1A according to the second exemplary embodiment is a printer of a type that causes the sheet 3 returned from the regulating rollers 44 for reverse printing to temporarily escape outside from the front surface of the main body casing 2. To this end, a return path P52 extending forwardly in the main body casing 2 is formed in place of the return path P51 extending upwardly within the main body casing 2 in the first exemplary embodiment.

As shown in FIGS. 12A and 12B, a manual feed port 81 is provided with a sheet width guide 83 for regulating the widthwise position of a manually-inserted sheet (the sheet 3). The sheet width guide 83 can be moved along the horizontal direction of FIG. 12B in conformance with the width of the employed sheet 3.

As mentioned above, since the laser printer is equipped with the sheet width guide 83, an area of the manual feed port 81 where the sheet 3 passes corresponds to an inner area of the sheet width guide 83 designated by reference numeral 84 shown in FIG. 12B.

In the laser printer 1A of the second exemplary embodiment, a return port 85 is provided in the main body casing 2 aside from a sheet feed section designated by reference numeral 84 in order to cause the sheet 3 to temporarily escape outside from the front of the main body casing 2. In the second exemplary embodiment shown in FIGS. 12A and 12B, the return port 85 is formed as a clearance located beneath the sheet width guide 83. In the laser printer 1A according to the second exemplary embodiment, the return path P52 is arranged on the extension of the leading end of the sheet 3 nipped between the regulating rollers 44 in such a way that the sheet 3 is conveyed to the return path P52 by means of the regulating rollers 44 that rotate in the return rotational direction during reverse printing. In the meantime, as shown in FIG. 12A, a guide wall 86 extending downwardly with increasing distance backward is formed on the extension of the leading end of the sheet 3 passed through the sheet width guide 83 in such a way that the sheet 3 is conveyed to the regulating rollers 44 during manual feeding of a sheet. The leading end of the sheet 3 fed from the manual feed port 81 collides against the guide wall 86, whereupon a traveling direction of the sheet is bent downwardly and the sheet proceeds toward the regulating rollers 44.

In the laser printer 1A according to the second exemplary embodiment, the sheet 3 is caused to temporarily escape outside the main body casing 2, and hence the return path may be kept short within the main body casing 2, which enables the laser printer 1A to be made smaller in size. Moreover, only the minimum length of the return path is used, and therefore clogging of the sheet 3, which would otherwise arise during inversion, can be prevented.

Although certain exemplary embodiments of the present invention have been described above, the present invention is not limited to the exemplary embodiments described above and can be modified in various forms. For instance, in the second exemplary embodiment, the return port 85 for causing the sheet 3 to escape outside is provided in a portion of the manual feed port 81. However, a return port completely separate from the manual feed port 81 can also be formed in the main body casing 2.

In the exemplary embodiments described above, the laser printer is exemplified as an example image forming apparatus. However, the present invention can also be applied to a digital multifunction machine or a copier.

The first sensor may also be positioned on; for instance, the return paths P51 and P52, the inversion path P4, or the supply path P2.

Positioning of the first sensor between the junction PX of the supply path P2 and the regulating rollers 44 is advantageous. However, even when the first sensor is positioned on the return paths P51 and P52, the inversion path P4, or the supply path P2, the sensor can perform detection for rotating the regulating rollers in the feed rotational direction.

The first sensor that performs detection for achieving timing at which the regulating rollers 44 are rotated in the return rotational direction may also be positioned on the inversion path P4 or the supply path P2.

Positioning the first sensor between the junction PX of the supply path P2 and the regulating rollers 44 is advantageous. However, even when the first sensor is positioned on such an inversion path P4 or the supply path P2, there can be performed detection for achieving a timing at which the regulating rollers 44 are rotated in the return rotational direction.

The second sensor for achieving a timing at which the regulating rollers 44 are rotated in the feed rotational direction may also be positioned at a location other than locations on the return paths P51 and P52. For example, the second sensor may also be placed on the supply path P2, the inversion path P4, or a location between the regulating rollers 44 and the junction PX of the inversion path P4 and the supply path P2.

Positioning the second sensor on the return paths P51 and P52 is advantageous. However, even when the second sensor is positioned on the supply path P2, the inversion path P4, or a position between the regulating rollers 44 and the junction PX of the inversion path P4 and the supply path P2, detection for rotating the regulating rollers 44 in the feed rotational direction can also be performed.

The third sensor for performing detection for reversely rotating the switchback rollers 79 may also be positioned at a location other than the location between the regulating rollers 44 and the junction PX of the inversion path P4 and the supply path P2. The third sensor may also be disposed on; for instance, the inversion path P4, the return paths P51 and P52, or the supply path P2.

Even when the switchback rollers 79 are positioned on the inversion path P4, the return paths P51 and P52, or the supply path P2, detection for reversely rotating the switchback rollers 79 can be carried out.

The sensor for the sheet 3 intended for achieving a timing at which the regulating rollers 44 are rotated in the feed rotational direction and the sensor for the sheet 3 intended for achieving a timing at which the regulating rollers 44 are rotated in the return rotational direction may also be provided separately from each other.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

an image forming unit configured to form an image on a recording sheet at an image forming position;

a regulating roller configured to regulate movement of a leading end of the recording sheet and conveys convey the recording sheet to the image forming position;

a supply path configured to supply the recording sheet conveyed from the regulating roller to the image forming position;

an inversion path that is configured to merge with a position on the supply path between the regulating roller and the image forming position, the inversion path inverting a course of the recording sheet by guiding the recording sheet conveyed from the image forming unit while bending the recording sheet and causing the recording sheet to merge with the supply path, thereby guiding the inverted recording sheet into the supply path in a reverse direction, a return path that is configured on an opposite side of the regulating roller from the supply path to return the recording sheet to the supply path;

a control unit configured to control a rotation of the regulating roller in a feed rotational direction and a return rotational direction opposite to the feed rotational direction;

wherein the control unit rotates the regulating roller in the return rotational direction to convey the inverted recording sheet into the return path, and rotates the regulating roller in the feed rotational direction to convey the recording sheet to the image forming position;

a recording sheet accommodating unit configured to accommodate recording sheets;

a recording sheet discharging unit into which the recording sheet conveyed from the image forming unit is discharged;

a feed path configured to invert the recording sheet fed from the recording sheet accommodating unit by bending the recording sheet and guide the inverted recording sheet to the regulating roller;

a discharge path configured to invert the recording sheet conveyed from the image forming unit by bending the recording sheet and guide the recording sheet to the recording sheet discharging unit; and a main body casing which houses the image forming unit, wherein the recording sheet accommodating unit, the image forming unit, and the recording sheet discharging unit are arranged in order;

the image forming unit comprises a cartridge that is detachably attached to the main body casing; and the cartridge comprises a cartridge-side return path comprising at least a portion of the return path.

2. The image forming apparatus according to claim 1, further comprising an exposure device, wherein the exposure device is disposed on a side of the cartridge closer to the recording sheet discharging unit, and the exposure device comprises a portion of the return path.

3. The image forming apparatus according to claim 1, further comprising:

a main body casing which houses the image forming unit and comprises a return opening that communicates with the return path;

a manual sheet feed opening formed in the main body casing;

a manual sheet supply path extending from the manual sheet feed opening to the regulating roller; and a sheet width guide that is provided at the manual sheet feed opening and that regulates a widthwise position of the recording sheet.

4. The image forming apparatus according to claim 1, wherein the control unit switches a rotating direction of the regulating roller to the feed rotational direction, once the recording sheet has been conveyed into the return path, thereby feeding the recording sheet again to the image forming position.

5. The image forming apparatus according to claim 4, wherein a sensor configured to detect the recording sheet is disposed between the regulating roller and a junction of the inversion path and the supply path; and the control unit rotates the regulating roller in the feed rotational direction based on an output from the sensor thereby feeding the recording sheet again to the image forming position.

6. The image forming apparatus according to claim 5, wherein the control unit stops the regulating roller after finishing conveyance of the recording sheet from the regulating roller to the image forming position and, when the sensor detects a first end corresponding to a leading end of the inverted recording sheet, the control unit rotates the regulating roller in the return rotational direction at a threshold timing based on an output of the sensor to thereby convey the recording sheet to the return path.

7. The image forming apparatus according to claim 1, further comprising:

a sensor configured to detect the recording sheet along the return path; and a switchback roller that is provided along the return path, wherein the control unit conveys the recording sheet into the return path by rotating the regulating roller in the return rotational direction;

rotates the switchback roller in a direction in which the recording sheet is further drawn into the return path;

stops rotation of the regulating roller after a second end, which corresponds to a trailing end of the inverted recording sheet, has passed the regulating roller and reverses a rotation of the switchback roller to convey the recording sheet back toward the regulating roller; and, after the sensor detects the second end of the recording sheet, rotates the regulating roller in the feed rotational direction at a threshold timing to feed the recording sheet to the image forming position.

8. The image forming apparatus according to claim 7, wherein the sensor detects the second end, and the control unit reverses the direction of the switchback roller based on an output of the sensor.

9. The image forming apparatus according to claim 7, wherein another sensor which detects the recording sheet is provided between the regulating roller and a junction of the inversion path and the supply path; and the switchback roller is rotated in reverse on condition that the other sensor has detected the recording sheet.

10. The image forming apparatus according to claim 1, wherein the image forming unit comprises a developing agent housing chamber comprising an agitator comprising a rotary shaft, and the regulating roller is disposed at a position in the supply path upstream of the rotary shaft.

11. The image forming apparatus according to claim 1, further comprising:

a loop path formation member which is configured to invert a course of the recording sheet by conveying the recording sheet conveyed from the image forming unit while bending the recording sheet, the loop path formation member being removable from the main body casing at a position in the supply path downstream of the image forming unit, wherein a portion of the inversion path is formed by the loop path formation member.

12. An image forming apparatus configured to form an image on either side of a recording sheet, the image forming apparatus comprising:

an image forming unit configured to form an image on a recording sheet at an image forming position;

a regulation member configured to regulate a leading end of the recording sheet;

a supply path which is configured to guide the recording sheet in a forward direction from the regulation member to the image forming position;

an inversion path that is configured to merge with a position on the supply path between the regulation member and the image forming position, the inversion path inverting a course of the recording sheet and guiding the inverted recording sheet to the supply path in a reverse direction;

a return path which is configured to receive the recording sheet guided from the inversion path to the supply path to a side of the regulation member opposite to the supply path;

a recording sheet accommodating unit configured to accommodate recording sheets;

a recording sheet discharging unit into which the recording sheet conveyed from the image forming unit is discharged;

a feed path configured to invert the recording sheet fed from the recording sheet accommodating unit by bending the recording sheet and guide the inverted recording sheet to the regulating roller;

a discharge path configured to invert the recording sheet conveyed from the image forming unit by bending the recording sheet and guide the recording sheet to the recording sheet discharging unit; and a main body casing which houses the image forming unit, wherein the recording sheet accommodating unit, the image forming unit, and the recording sheet discharging unit are arranged in order;

the image forming unit comprises a cartridge that is detachably attached to the main body casing; and the cartridge comprises a cartridge-side return path comprising at least a portion of the return path.

13. An image forming apparatus comprising:

an image forming unit disposed at an image forming position;

a regulating roller provided upstream of the image forming position in a sheet conveyance direction;

a supply path provided between the regulating roller and the image forming position;

a loop path formation member provided downstream of the image forming position in the sheet conveyance direction;

an inversion path provided from the loop path formation member to a position on the supply path that is downstream of the regulating roller and upstream of the image forming position in the sheet conveyance direction, a portion of the inversion path running parallel to the supply path;

a return path provided upstream, in the sheet conveyance direction, of the regulating roller;

a recording sheet accommodating unit configured to accommodate recording sheets;

a recording sheet discharging unit into which the recording sheet conveyed from the image forming unit is discharged;

a feed path configured to invert the recording sheet fed from the recording sheet accommodating unit by bending the recording sheet and guide the inverted recording sheet to the regulating roller;

a discharge path configured to invert the recording sheet conveyed from the image forming unit by bending the recording sheet and guide the recording sheet to the recording sheet discharging unit; and a main body casing which houses the image forming unit, wherein the recording sheet accommodating unit, the image forming unit, and the recording sheet discharging unit are arranged in order;

the image forming unit comprises a cartridge that is detachably attached to the main body casing; and the cartridge comprises a cartridge-side return path comprising at least a portion of the return path.

* * * * *